United States Patent [19]

Miyata

[11] 4,151,383

[45] Apr. 24, 1979

[54] LEAF-SPRING SWITCH

[75] Inventor: Muneyoshi Miyata, Tokyo, Japan

[73] Assignee: Mitsuku Denki Kogyo K.K., Tokyo, Japan

[21] Appl. No.: 902,754

[22] Filed: May 3, 1978

[51] Int. Cl.[2] ..... H01H 21/04

[52] U.S. Cl. ..... 200/67 D; 337/343

[58] Field of Search ..... 200/67 D, 83 P; 337/89, 337/343, 365

[56] References Cited

U.S. PATENT DOCUMENTS

| | | | |
|---|---|---|---|
| 2,558,219 | 6/1951 | Kohl | 337/343 |
| 2,769,890 | 11/1956 | Hallerberg et al. | 337/89 |
| 2,892,050 | 6/1959 | Fisher | 200/67 D |
| 3,624,323 | 11/1971 | Borgmann | 200/67 D |

*Primary Examiner*—Steven L. Stephan

*Attorney, Agent, or Firm*—Oblon, Fisher, Spivak, McClelland & Maier

[57] ABSTRACT

A leaf-spring switch comprising an insulating switch base having parallel upper and lower arms each having a claw on the inside of its free end, upper and lower leaf springs provided midway between and in parallel with the arms, the upper leaf spring being provided at its one end with a tongue-shaped projection and a first contact and at its other end with a terminal, the lower leaf spring being provided at its central portion with a finger plate surrounded by a U-shaped slit larger in width than the upper leaf spring, the finger plate having a second contact at its one end, the lower leaf spring being provided at its one end with a lug and at its other end with a terminal, the upper and lower springs being fixed by the switch base so that the first and second contacts may face each other, a semicircular toggle spring provided at its one end with a forked part which engages the lug and at its other end with a narrow section smaller in width than the U-shaped slit, and the narrow section of the toggle spring having a slit which engages the tongue-shaped projection of the upper leaf spring, wherein the combined spring forces of the upper and lower leaf springs and the toggle spring make the on-off action very rapid.

4 Claims, 8 Drawing Figures

LEAF-SPRING SWITCH

BACKGROUND OF THE INVENTION

1. Field of the Invention

The present invention relates generally to the construction of leaf springs and, more particularly, to a leaf-spring switch simple in construction and excellent in performance.

2. Description of the Prior Art

For the conventional switches of such a type as to open and close an electric circuit by a combination of leaf and toggle springs, there have been heretofore proposed a variety of mechanisms. However, most of them have disadvantages in that they are complicated in construction and therefore uneconomical because of much time and labor required when assembled. Also, they are short of snap-action performance, reliability, durability and the like or liable to failure when in use.

BRIEF SUMMARY OF THE INVENTION

The present invention therefore is intended to eliminate the above-mentioned disadvantages of the prior art and to provide a new and novel leaf-spring switch.

It is an object of the present invention to provide a leaf-spring switch excellent in snap-action performance, reliability, durability and the like.

It is another object of the present invention to provide a leaf-spring switch simple in construction that can save labor in its assembly operation.

It is still another object of the present invention to provide a leaf-spring switch that can be mass-produced without any skilled labor.

According to the present invention, there is provided a leaf-spring switch which comprises an insulating switch base having upper and lower arms spaced a predetermined distance apart and provided substantially in parallel with each other. Each of the arms includes a claw on the inside of the free end thereof, and upper and lower leaf springs are spaced a predetermined distance apart and provided midway between and substantially in parallel with the arms. The upper leaf spring is provided at its one end with a tongue-shaped projection and a first contact and at its other end with a terminal. The lower leaf spring is provided at its central portion with a longitudinally-extending finger plate surrounded by a U-shaped slit larger in width than the upper leaf spring. The finger plate includes a second contact at its one end, and the lower leaf spring is provided at its one end with a lug and at its other end with a terminal. The upper and lower leaf springs are fixed by the switch base so that the first and second contacts may face each other. A semicircular toggle spring of a predetermined width is provided at its one end with an outward-folded forked part which engages the lug and at its other end with a narrow section of a predetermined length small in width than the U-shaped slit of the lower leaf spring. The narrow section of the toggle spring having a slit which engages the tongue-shaped projection is provided on the upper leaf spring.

DETAILED DESCRIPTION OF THE PREFERRED EMBODIMENTS

Figure 1:
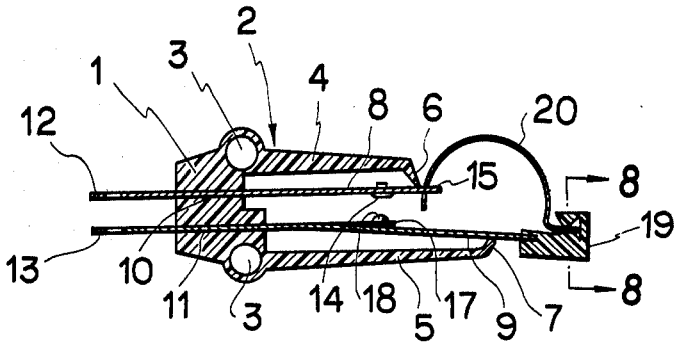
FIG. 1 is a longitudinal sectional side view of a leaf-spring switch according to a preferred embodiment of the present invention illustrating the switch block thereof as it appear in a normal, or switch-off condition.

The present invention will be hereinafter described in detail with reference to the accompanying drawings.

Reference numeral 1 designates an elastic, insulating and durable switch base molded out of suitable plastic material and having suitable dimentions. Reference numeral 2 designates a switch block composed chiefly of the switch base 1 mentioned above and an upper leaf spring 8, a lower leaf spring 9, an insulating lug 19 and a toggle spring 20 which will be later described. The switch base 1 is provided with two through-holes 3 for passing bolts therethrough so as to fix the switch block 2 on a supporting plate or the like (not shown) thereby incorporating it in an electric circuit (not shown).

Figure 2:
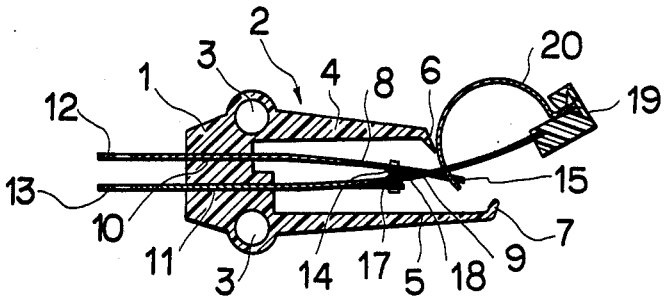
FIG. 2 is a view similar to FIG. 1 illustrating the switch block as it appear in a switch-on condition.
Figure 3:
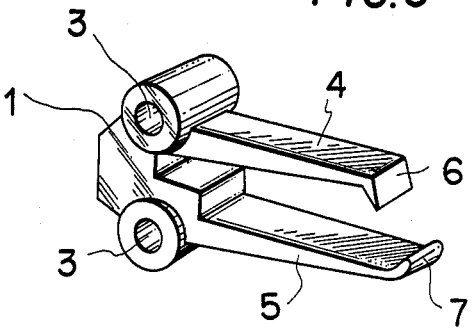
FIG. 3 is a perspective view of a switch base for use in the present invention.
Figure 4:
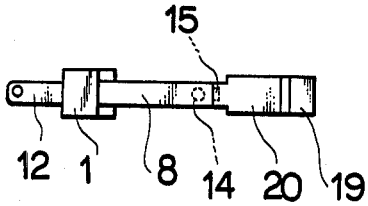
FIG. 4 is a plan view of an upper leaf spring for use in the present invention.
Figure 5:
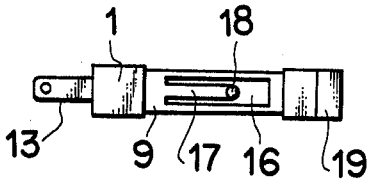
FIG. 5 is a plan view of a lower leaf spring for use in the present invention.
Figure 6:
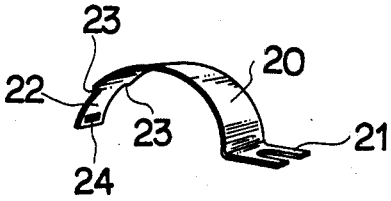
FIG. 6 is a perspective view of a toggle spring for use in the present invention.
Figure 7:
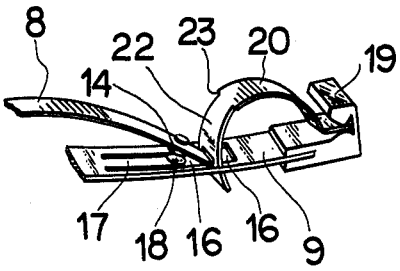
FIG. 7 is a perspective view illustrating the foregoing upper and lower leaf springs and toggle spring as they appear when they engage one another.
Figure 8:
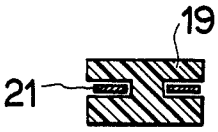
FIG. 8 is a sectional view taken along line 8—8 of FIG. 1.

The switch base 1 is provided with an upper arm 4 and a lower arm 5 extending forward (or rightward in FIG. 1 or FIG. 2) with a predetermined vertical space therebetween and substantially in parallel with each other. The arms 4 and 5 are provided at their ends with claws 6 and 7 curved inward and inclined forward. Midway between the upper and lower arms 4 and 5, there are provided an upper leaf spring 8 and a lower leaf spring 9 extending forward with a predetermined vertical space therebetween and substantially in parallel with the arms 4 and 5. In addition, the leaf springs 8 and 9 are provided so that the respective base sections 10 and 11 thereof are formed integrally with the switch base 1 and fixed therein so that the free end area of the upper leaf spring 8 and that of the lower leaf spring 9 may be in resilient contact with the end of the claw 6 and that of the claw 7, respectively. Besides, the leaf springs 8 and 9 extend backward (or leftward in FIG. 1 or 2) through the base sections 10 and 11 thereof to form terminals 12 and 13, respectively. The upper leaf spring 8 is smaller in width than the lower leaf spring 9, being provided on its lower side in the vicinity of its free end with a first contact 14 and at the free end thereof with a tongue-shaped projection extending forward. The lower leaf spring 9 is provided at its inside with a longitudinally-extending finger plate 17 surrounded by a U-shaped slit 16 and having a second contact 18 on the upper side of its free end. The first and second contacts 14 and 18 are positioned so that they may face each other. The slit 16 is greater in width than the upper leaf spring 8. An insulating lug 19 of insulating material is provided at the free end of the lower leaf spring 9. A toggle spring 20 is an independently-formed semicircular part having a predetermined width (a), being provided at its front end with an outward-folded forked part 21 with a pair of legs for engaging with the lug 19 and at its rear end with a narrow section 22 having a predetermined length and a width (b) smaller than the width of the slit 16. The width (a) of the toggle spring 20 and the width (b) of the narrow section 22 thereof are selected so that they are substantially equal to the widths of the lower leaf spring 9 and the upper leaf spring 8, respectively. The main section of the toggle spring 20 having the width (a) and the narrow section 22 thereof are connected to each other through a shoulder 23. The narrow section 22 of the toggle spring 20 is provided at its portion near its end with a slit 24 for engaging with the projection 15 of the upper leaf spring 8. The toggle spring 20 is manually set in place for engagement with the upper leaf spring 8 and the lug 19.

With the construction mentioned above, the lug 19 is resiliently urged downward and the upper and lower leaf springs 8 and 9 are strongly pressed against the claws 6 and 7 respectively, by the combined action of the upper and lower leaf springs 8 and 9 and the toggle spring 20. Thus, the lug 19 is strongly kept stationary, being prevented from movement caused by external forces such as vibration and impact. In this state, the first contact 14 and the second contact 18 are securely held at a switch-off position.

If, in this state, the lug 19 is pushed up, for instance, manually or mechanically, the front section of the lower leaf spring 9 is bent upward with the finger plate 17 kept straight and the front section of the upper leaf spring 8 and the narrow section 22 of the toggle spring 20 are moved downward through the slit 16 to project under the lower leaf spring 9. In this condition, the upper surface of the toggle spring 20 is brought into contact with the front outside surface of the claw 6. More particularly, the toggle spring 20 slides on the outside surface of the claw 6 as the lug 19 is pushed up, and thereby to be radially compressed. When a change point is passed, the front section of the upper leaf spring 8 and the narrow section 22 of the toggle spring 20 engaging each other are instantaneously brought downward by a snap action caused by the combined forces of the toggle spring 20 and the upper leaf spring 8, and thereby are projected under the lower leaf spring 9 as mentioned above. At this time the first contact 14 is instantaneously brought into contact with the second contact 18 under pressure thereby achieving a switch-on state. If, in this state, the lug 19 is further pushed up, the shoulder 23 of the toggle spring 20 comes into contact with the edges of the slit 16 thereby preventing the further push-up of the lug 19. In other words, the shoulder 23 of the toggle spring 20 functions as a stopper for determining the upper limit of the push-up stroke of the lug 19.

If, in the above-mentioned switch-on state, the lug 19 is released from the push-up operation, it instantaneously returns to its original position thereby instantaneously separating the first contact 14 from the second contact 18 to achieve a switch-off state.

It is well known that the greater the speed of the on-off action of the switch is, the more desirable it becomes. In view of this fact, the present invention has achieved an extremely fast on-off action of the switch as mentioned above.

It will be understood from the foregoing description that the leaf-spring switch according to the present invention is very simple in construction and can achieve a very fast on-off action by utilizing the combined spring forces of the upper and lower leaf springs 8 and 9 and the toggle spring 20, that it can securely hold an on or off state without being influenced by external forces, that its parts may be integrally molded except the toggle spring 20 which is manually assembled and therefore they can be securely fixed in place and as a result it is free of trouble when in use, and that it requires no skilled labor and enables economical mass-production.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A leaf-spring switch comprising an insulating switch base having upper and lower arms spaced a predetermined distance apart and provided substantially in parallel with each other, said arms each having a forward-inclined claw on the inside of the free front end thereof, upper and lower leaf springs spaced a predetermined distance apart and provided midway between said upper and lower arms and substantially in parallel with said upper and lower arms, said upper leaf spring being provided at one of its ends with a tongue-shaped projection and a first contact and at its other end with a terminal, said lower leaf-spring being provided at its central portion with a longitudinally-extending finger plate surrounded by a U-shaped slit larger in width than said upper leaf spring, said finger plate having a second contact at its end, said lower leaf spring being provided at one of its ends with an insulating lug and at its other end with a terminal, said upper and lower leaf springs being fixed at the base section thereof by said switch base so that they may be in the form of cantilevers and so that said first and second contacts thereon may face each other, a toggle spring having a predetermined width and formed of a semicircular plate, said toggle spring being provided at one of its ends with an outward-folded forked part which engages said insulating lug and at its other end with a narrow section of a predetermined length smaller in width than said U-shaped slit of said lower leaf spring, and said narrow section of said toggle spring having a slit which engages said tongue-shaped projection of said upper leaf spring.

2. The leaf-spring switch as set forth in claim 1, wherein said upper leaf spring is, at its one end, in resilient contact with the end of said claw of said upper arm, and said lower leaf spring is, at its one end, in resilient contact with the end of said claw of said lower arm so that the externally-directing resilient forces of said upper and lower springs may be increased and so that unexpected vertical movements of said upper and lower leaf springs due to external forces may be prevented.

3. The leaf-spring switch as set forth in claim 1, wherein said toggle spring has a shoulder between the main section and narrow section thereof so that said shoulder may prevent said toggle spring from entering said U-shaped slit deeper than a predetermined extent.

4. The leaf-spring switch as set forth in claim 1, wherein the outside surface of said toggle spring slides on the outside surface of said claw of said upper arm while kept in contact with each other so that the toggle spring may be radially compressed to increase the restoring force thereof.

* * * * *